US010000976B2

(12) United States Patent
Matthias et al.

(10) Patent No.: US 10,000,976 B2
(45) Date of Patent: Jun. 19, 2018

(54) CUTTING ELEMENT

(71) Applicant: NOV Downhole Eurasia Limited, Stonehouse, Gloucestershire (GB)

(72) Inventors: Terry Matthias, Upton St. Leonards (GB); Haydn G. Smith, Dursley (GB)

(73) Assignee: NOV Downhole Eurasia Limited, Gloucestershire (GB)

( * ) Notice: Subject to any disclaimer, the term of this patent is extended or adjusted under 35 U.S.C. 154(b) by 182 days.

(21) Appl. No.: 14/780,011

(22) PCT Filed: Mar. 12, 2014

(86) PCT No.: PCT/GB2014/050740

§ 371 (c)(1),
(2) Date: Sep. 25, 2015

(87) PCT Pub. No.: WO2014/155055

PCT Pub. Date: Oct. 2, 2014

(65) Prior Publication Data

US 2016/0047170 A1 Feb. 18, 2016

(30) Foreign Application Priority Data

Mar. 26, 2013 (GB) ..... 1305483.8

(51) Int. Cl.
*E21B 10/567* (2006.01)
*E21B 10/573* (2006.01)
(Continued)

(52) U.S. Cl.
CPC ..... *E21B 10/567* (2013.01); *B24D 18/0009* (2013.01); *E21B 10/573* (2013.01); *E21B 10/5735* (2013.01)

(58) Field of Classification Search
USPC ..... 175/428
See application file for complete search history.

(56) References Cited

U.S. PATENT DOCUMENTS 6,258,139 B1 * 7/2001 Jensen ..... B23B 27/141 428/408
7,703,559 B2 * 4/2010 Shen ..... E21B 10/5673 175/426

(Continued)

FOREIGN PATENT DOCUMENTS

GB 2304358 3/1997
GB 2486800 6/2012

OTHER PUBLICATIONS

Search Report for GB1305483.8 dated Aug. 14, 2013.
International Search Report for PCT/GB2014/050740 dated Nov. 27, 2014.

*Primary Examiner* — Matthew R Buck
*Assistant Examiner* — Douglas S Wood
(74) *Attorney, Agent, or Firm* — Andrus Intellectual Property Law, LLP

(57) ABSTRACT

A cutting element comprises a primary cutter including a first table of a hard material bonded to a first substrate of less hard form, the first substrate of the primary cutter having a recess formed therein in which a secondary cutter is located, the secondary cutter comprising a second table of a hard material bonded to a second substrate of less hard material, the first and second tables being spaced apart from one another by at least part of the first substrate.

21 Claims, 5 Drawing Sheets

(51) Int. Cl.

| | |
|---|---|
| ***B24D 18/00*** | (2006.01) |
| *C22C 1/05* | (2006.01) |
| *B24D 3/00* | (2006.01) |
| *B24D 3/10* | (2006.01) |
| *B24D 99/00* | (2010.01) |
| *C22C 26/00* | (2006.01) |
| *C22C 29/06* | (2006.01) |
| *C22C 29/14* | (2006.01) |

(56) References Cited

U.S. PATENT DOCUMENTS

| | | | | |
|---|---|---|---|---|
| 8,511,405 | B2 * | 8/2013 | Frazier | E21B 10/5676 175/428 |
| 9,260,923 | B1 * | 2/2016 | Bertagnolli | E21B 10/567 |
| 2007/0278017 | A1 | 12/2007 | Shen | |
| 2011/0061944 | A1 * | 3/2011 | Scott | B01J 3/062 175/428 |
| 2011/0226532 | A1 * | 9/2011 | Jonker | B22F 7/062 175/57 |
| 2012/0151848 | A1 | 6/2012 | Suryavanshi | |

* cited by examiner

CUTTING ELEMENT

CROSS REFERENCE TO RELATED APPLICATIONS

The present application is the U.S. national stage application of International Application PCT/GB2014/050740, filed Mar. 12, 2014, which international application was published on Oct. 2, 2014, as International Publication WO2014/155055. The International Application claims priority of British Patent Application 1305483.8, filed Mar. 26, 2013, the contents of which are incorporated herein by reference in their entireties.

FIELD

This invention relates to a cutting element for use in a drill bit. In particular, it relates to a cutting element suitable for use on a rotary drag type drill bit, such as those used in the formation of boreholes in subterranean formations. The cutting element may further be used on, for example, bore enlarging tools such as concentric or eccentric hole openers, reamers, or the like.

BACKGROUND

A typical rotary drag type drill bit comprises a bit body which may be formed with a series of upstanding, generally radially extending blades. Each blade is typically provided with a series of cutting elements positioned such that, in use, when a weight is applied to the drill bit whilst the bit is driven for rotation about its axis, the cutting elements bear against the adjacent formation, scraping, gouging, abrading, cutting or otherwise removing the formation material, and thereby extending the length of a borehole. Often, a fluid is pumped into the borehole, for example being supplied through nozzles formed in the drill bit, and serving to clean and cool the cutting elements and to carry away the formation material removed in this fashion.

One common form of cutting element comprises a table or layer of a superhard material such as polycrystalline diamond bonded to a substrate of a less hard material such as tungsten carbide. The cutters are typically sintered under high temperature, high pressure conditions. After sintering, further procedures may be undertaken to remove a binder or catalysing material from parts thereof, and to clean and shape the cutting element.

In use, as a result of their engagement with the formation material, the cutting elements affixed to a drill bit will become worn, reducing the effectiveness of the drill bit. A point will be reached beyond which the drill bit requires replacement. Since replacement of a drill bit requires the drilling operation to be stopped and the drill string to which the drill bit is connected to be withdrawn from the borehole, before the drill bit can be replaced and introduced into the borehole, it will be appreciated that the act of replacement of a drill bit causes significant delays and incurs significant cost. It is desirable, therefore, to extend the working life of a drill bit which can be achieved by extending the working life of the cutting elements used on a drill bit. Consequently, replacement of a drill bit may be undertaken less frequently.

U.S. Pat. No. 5,025,874, U.S. Pat. No. 5,217,081, U.S. Pat. No. 6,065,554 and U.S. Pat. No. 6,986,297 all describe cutting elements for use on drill bits for the formation of boreholes. In the U.S. Pat. No. 5,025,874 arrangement, a layer of a superhard material is formed within a substrate such that the layer is, in effect, positioned between and bonded to two substrates. The element can then be divided to form two separate cutting elements. U.S. Pat. No. 5,217,081 describes a cutting element in which a substrate thereof includes cobalt rich and cobalt lean carbide regions. U.S. Pat. No. 6,065,554 describes a cutting element comprising a primary cutter including a table of superhard material provided on a substrate. A recess is formed in the front, superhard material covered face of the primary cutter in which an insert is provided, the insert itself having a superhard material front face displaced forwardly of the front face of the primary cutter. A similar structure to that of U.S. Pat. No. 6,065,554 is described in U.S. Pat. No. 6,986,297.

U.S. Pat. No. 6,258,139, US2013/0151848, GB2304358 and U.S. Pat. No. 5,979,578 all describe cutting element arrangements in which separate, distinct hard material regions are provided. The regions are typically provided by sintering simultaneously with one another.

SUMMARY

It is an object of the invention to provide a cutting element of extended working life.

According to the invention there is provided a cutting element comprising a primary cutter including a first table of a hard material bonded to a first substrate of less hard form, the first substrate of the primary cutter having a recess formed therein in which a secondary cutter is located, the secondary cutter comprising a second table of a hard material bonded to a second substrate of less hard material, the first and second tables being spaced apart from one another by at least part of the first substrate.

Before use, the second table may be enclosed within the first substrate. Alternatively, it may project therefrom.

Where the second table is initially enclosed within the first substrate, upon initial use of the drill bit, the second table will not engage the formation, and so drilling is undertaken primarily by the interaction between the first table and the formation. Use of the drill bit will result in wear of the first table and first substrate, and such wear may result in part of the second table becoming exposed, subsequent drilling being undertaken by a combination of the interactions of both the first table and the second table with the formation. The provision of the second table thus permits an increase in the working life of the cutting element and associated drill bit.

Where the second table is initially partially exposed, and depending upon the protrusion, rake angle and/or rate of penetration, it will be appreciated that from the outset drilling may be performed by both the first table and the second table. The presence of the second table undertaking part of the drilling action will result in a reduction in wear of the first table, extending the working life of the cutting element and drill bit. By appropriate selection of the protrusion, and/or control over the rake angle or rate of penetration it may be possible for the initial part of the drilling to be undertaken by either the first table, the second table or the two tables in combination.

The first and second tables may be of the same material as one another. Alternatively, they may be of different materials. One or other, or both, may be treated to remove a binder or catalyst material from at least part thereof, if desired. The tables may be of, for example, tungsten carbide, silicon carbide, boron nitride, diamond, boron nitride carbide, polycrystalline diamond or polycrystalline cubic boron nitride.

The first and second substrates may be of the same material as one another, or may be of differing materials. They may comprise a carbide, for example tungsten carbide.

The invention further relates to a method of manufacture of a cutting element comprising the steps of sintering a primary cutter, the primary cutter including a first table of a hard material bonded to a first substrate of less hard form, the first substrate of the primary cutter having a recess formed therein, sintering a secondary cutter, the secondary cutter comprising a second table of a hard material bonded to a second substrate of less hard material, and locating the secondary cutter in the recess formed in the first substrate such that the first and second tables are spaced apart from one another by at least part of the first substrate.

BRIEF DESCRIPTION OF THE DRAWINGS

The invention will further be described, by way of example, with reference to the accompanying drawings, in which.

DETAILED DESCRIPTION OF THE DRAWINGS

Figure 1:
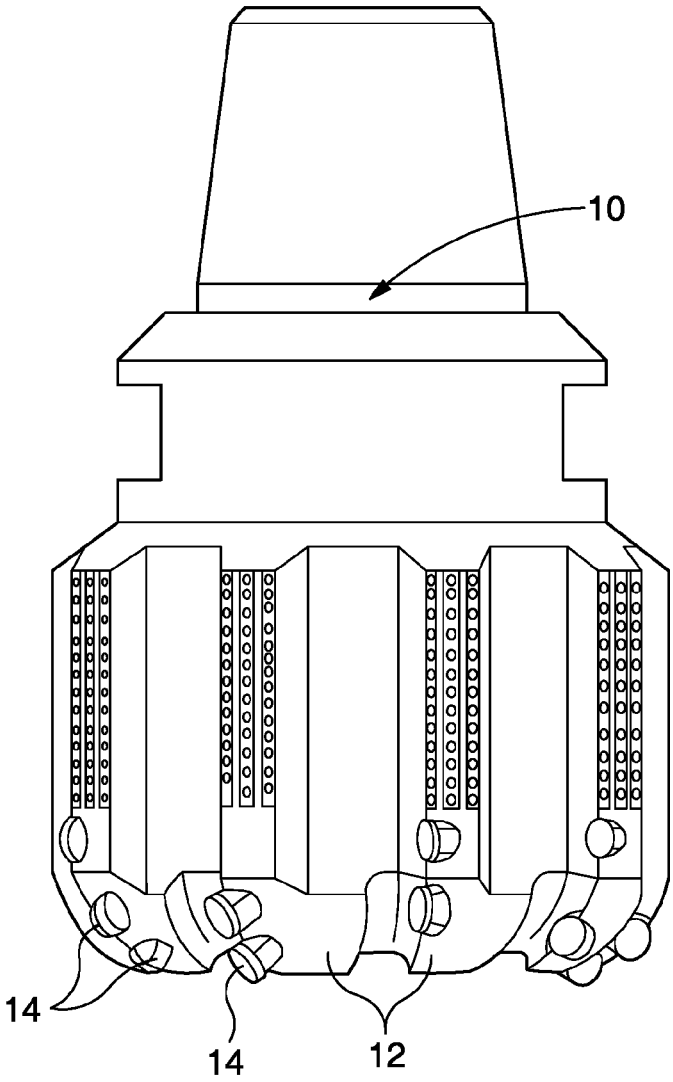
FIG. 1 is a view illustrating a drill bit.

Referring firstly to FIG. 1, a rotary drag type drill bit is illustrated which comprises a bit body 10 including a series of upstanding blades 12 formed integrally therewith. Each blade defines a leading edge, and a row of cutting elements 14 is mounted upon each blade 12 adjacent the leading edge thereof. Each cutting element 14 is secured to the bit body 10 by being brazed or otherwise secured within a respective pocket formed in the blade 12.

In use, the drill bit is mounted upon a drill string extending into a borehole with the blades 12 and cutting elements 14 bearing against the formation material at or adjacent the bottom of the borehole. A weight on bit loading is applied to the drill bit, for example via the drill string, and the drill bit is driven for rotation about its axis. The rotary drive may be applied by rotation of the drill string and/or by a downhole located motor.

The rotation of the drill bit whilst a weight on bit loading is applied thereto results in the cutting elements 14 scraping, abrading, gouging or otherwise removing formation material from the end part of the borehole, extending the borehole. Depending upon the manner in which the drill bit is used, the direction in which the borehole is extended may be controlled so as to ensure that the borehole follows a preferred path or trajectory through the formation.

Figure 2A:
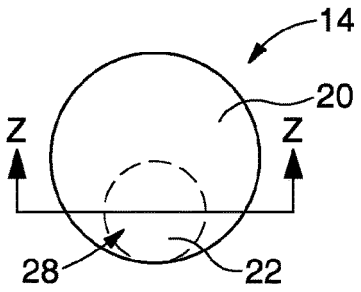
FIGS. 2*a* and 2*b* are diagrammatic end and cross-sectional views illustrating one of the cutting elements of the drill bit of FIG. 1.
Figure 2B:
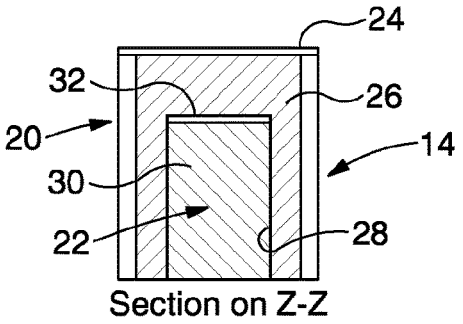

Each cutting element 14, or at least some of the cutting elements 14, takes the form illustrated in FIGS. 2*a* and 2*b*. These cutting elements 14 thus comprise a primary, outer cutter 20 and a secondary, inner cutter 22. The primary cutter 20 comprises a first table 24 of a hard material bonded to a first substrate 26 of a less hard material. The first substrate 26 is conveniently of generally cylindrical form, with the first table 24 being bonded to a substantially circular end face thereof. The first table 24, in the arrangement illustrated, is of polycrystalline diamond form, bonded to the first substrate 26 which is of tungsten carbide form. However, it will be appreciated that the invention is not restricted to these materials. By way of example, the first table 24 may be selected from a list of materials including tungsten carbide, silicon carbide, boron nitride, diamond, boron nitride carbide, or polycrystalline cubic boron nitride, and other materials, for example other carbide materials, may be used for the first substrate 26. If desired, a leaching operation, or another suitable operation, may be carried out to remove a binder or catalyst material from at least part of the first table 24.

The primary cutter 20 is conveniently manufactured by the use of a conventional high temperature, high pressure sintering process.

A substantially cylindrical recess 28 is formed in the first substrate 26, the recess 28 being formed in the surface of the first substrate 26 remote from the first table 24. In the arrangement of FIG. 2*a*, the recess 28 is formed eccentrically with the first substrate 26. However, this need not always be the case, and concentric or substantially concentric arrangements are possible. The recess 28 may be formed in any suitable manner. For example, it may be formed by the use of electronic discharge machining, or by milling. Alternatively, it could be provided by forming the substrate in two parts which are bonded to one another, one of the parts being bonded to the first table and the other of the parts being formed with a through hole prior to bonding thereof, the through hole serving to form the recess. The position and size of the recess 28 are conveniently such that it extends substantially to the periphery of the first substrate 26.

The secondary cutter 22, like the primary cutter 20, comprises a generally cylindrical second substrate 30 to which is bonded a second table 32. The second table 32 and second substrate 30 may be of the same materials as the first table 24 and first substrate 26. However, this need not be the case. They may be produced using substantially the same techniques as used in the formation of the primary cutters 20, the primary and secondary cutters conveniently being pre-sintered and subsequently assembled to form the cutting element by introducing or locating the secondary cutter within the recess provided in the first substrate of the primary cutter.

The secondary cutter 22 is of smaller diameter and shorter axial length than the primary cutter 20, being of substantially the same dimensions as the recess 28 formed in the primary cutter 20, and is fitted into the recess 28 with the second table 32 located at the end of the recess 28 closest to the first table 24. The secondary cutter 22 may be an interference fit within the recess 28. Alternatively, it may be secured in position by brazing or by the use of mechanical locking features, or by any other suitable techniques.

Like the primary cutter 20, the second table 32 may be treated prior to the introduction of the secondary cutter 22 into the recess 28 to leach or otherwise remove at least some of the binder or catalyst material from parts thereof.

It will be appreciated that in this arrangement, the first and second tables 24, 32 are spaced apart from one another by a part of the first substrate 26. The orientation of the first and second tables 24, 32 in this embodiment is such that they are substantially parallel to one another.

In use, initially the cutting element 14 is of cylindrical form with the second table 32 enclosed entirely within the primary cutter 20. Rotation of the drill bit with a weight on bit loading applied thereto will result in the borehole being extended in the usual manner, the drilling being accomplished primarily as a result of the interaction between the first table 24 of the primary cutter 20 and the formation material.

Figure 3:
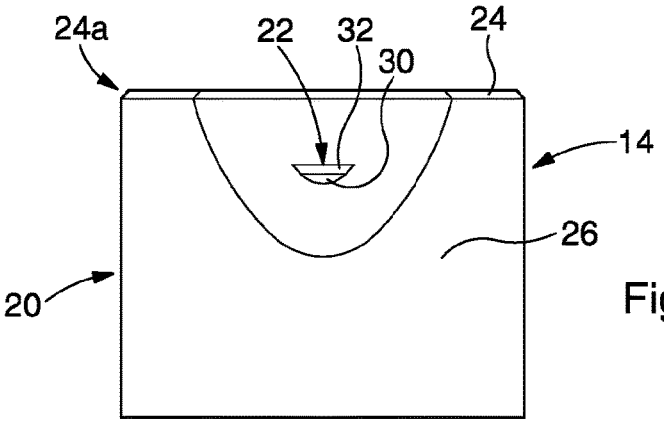
FIGS. 3 and 4 illustrate the cutting element of FIGS. 2*a* and 2*b* in a part worn condition.
Figure 4:
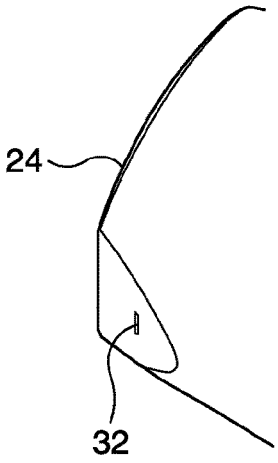

Use of the drill bit will result in the cutting elements 14 thereof becoming worn as a result of the abrasion between the cutting elements 14 and the formation material. FIGS. 3 and 4 illustrate the cutting element 14 of FIGS. 2*a* and 2*b* in a part worn condition. As shown in FIGS. 3 and 4, the wear has resulted in part of the first table 24 and part of the underlying first substrate 26 being abraded, exposing part of the second table 32 and second substrate 30 of the secondary cutter 22. During continued use of the drill bit, drilling is accomplished by the interaction of both the exposed part of the secondary cutter 22 and the primary cutter with the formation material. As a result, the cutting element 14 will continue to operate effectively for an increased period of time compared to a typical cutting element. The enhanced working lifespan of the cutting element 14 allows the drill bit to continue to be used for an extended period of time before requiring replacement.

Figure 7:
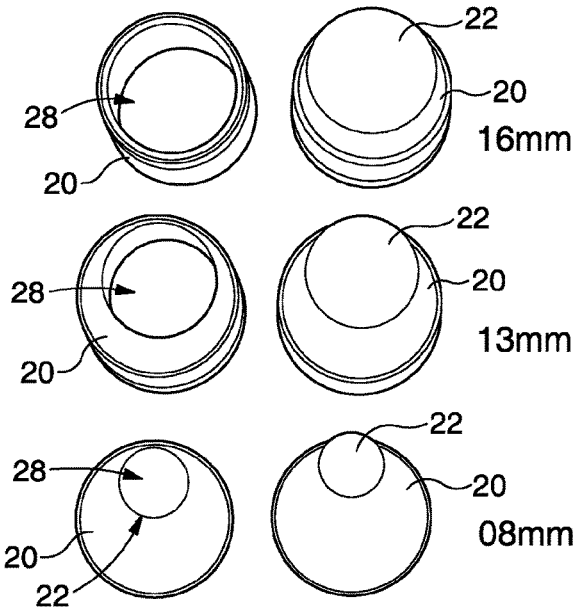
FIG. 7 is a photograph showing some variants.

As mentioned hereinbefore, the primary and secondary cutters 20, 22 are conveniently arranged eccentrically relative to one another, allowing the use of a relatively small diameter secondary cutter 22. By way of example, where the primary cutter diameter is 19 mm, the eccentric positioning of the secondary cutter may allow an 8 mm cutter to be used instead of a, say, 16 mm cutter. FIG. 7 shows several possibilities, both for the case where the secondary cutter 22 is enclosed within the primary cutter 20 and where is protrudes therefrom. The axes of the cutters do not need to be parallel to one another. By way of example, the axis of the secondary cutter 22 may be angled relative to that of the primary cutter 20, for example by an angle falling within the range of 0 to 90°, although larger angles may be used if desired. It is thought that by angling the axis of the secondary cutter 22 relative to that of the primary cutter 20, and by appropriately orientating the cutting element 14 on the drill bit, the secondary cutter 22 may serve to provide depth of cut control as it will tend to limit the distance by which the cutting edge of the primary cutter 20 is able to penetrate the formation.

As illustrated, if desired, the first and/or second tables 24, 32 may have chamfered edges. The chamfers preferably extend through only part of the thickness of the respective tables.

Whilst described as being of cylindrical form, it will be appreciated that the cutters 20, 22 need not be of this form, and need not be of the same shape as one another.

Depending upon the manner in which the secondary cutter 22 is secured or retained within the primary cutter 20, the secondary cutter 22 may be arranged such that rotary motion of the secondary cutter 22 relative to the primary cutter 20 is possible. By permitting the secondary cutter 22 to rotate in this manner, substantially the entire periphery of the second table 32 may be used during the cutting or drilling operation, further enhancing the lifespan of the cutting element 14.

Figure 9:
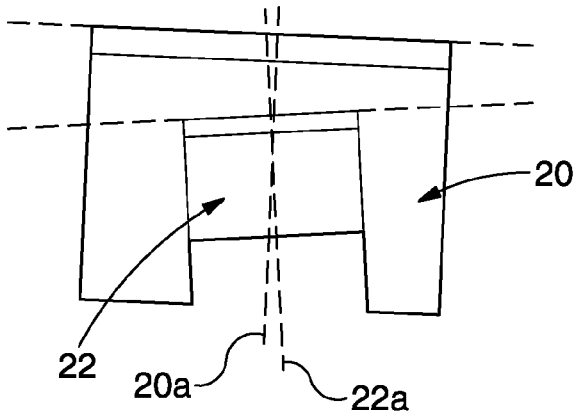

In order to promote rotation of the (or each) secondary cutter 22 relative to the primary cutter 20, it may be preferred to orientate the secondary cutter 22 such that its axis 22*a* is angled to the axis 20*a* of the associated primary cutter, for example as shown in FIG. 9. As a result, the cutting faces of the primary and secondary cutters 20, 22 are not parallel to one another. In such an arrangement, when the secondary cutter 22 engages the formation during drilling, the engagement between the secondary cutter 22 and the formation will tend to rotate the secondary cutter 22 relative to the primary cutter 20. In such an arrangement, the primary and secondary cutters 20, 22 may have different backrake angles to one another and, if desired, they may have different siderake angles. The secondary cutter 22 may have a siderake angle within the range of 0-45°, if desired.

Figure 10:
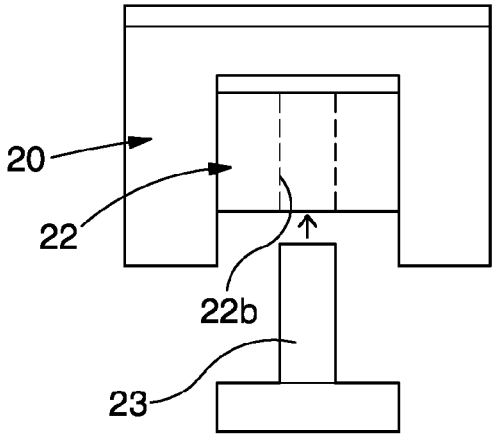

There is a risk that, in use, the loads experienced by the primary cutter 20 could result in axial or substantially axial compression of the substrate thereof, potentially causing the secondary cutter 22 to become pinched or trapped within the substrate of the primary cutter 22, or between the substrate of the primary cutter 20 and the bit body 10 or mount used to locate the cutting element upon the bit body 10. Such pinching could prevent the secondary cutter 22 from rotating. In order to reduce the risk of this, as shown in FIG. 10, it may be desired to form a passage 22*b* extending through the secondary cutter 22, a load transmitting member 23 extending through the passage 22*b* and being arranged to transmit axial loads through the first cutter 20 whilst avoiding or reducing axial compression of the primary cutter 20 so that the secondary cutter 22 does not become pinched but rather remains free to rotate. The passage 22*b* and load transmitting member 23 are dimensioned such that there is a clearance therebetween, permitting the aforementioned rotation. The load transmitting member 23 is conveniently an interference fit within the substrate of the primary cutter 20.

If desired, the arrangement of FIG. 10 may be modified such that the axis of the secondary cutter 22 is angled to that of the primary cutter 20.

Figure 5A:
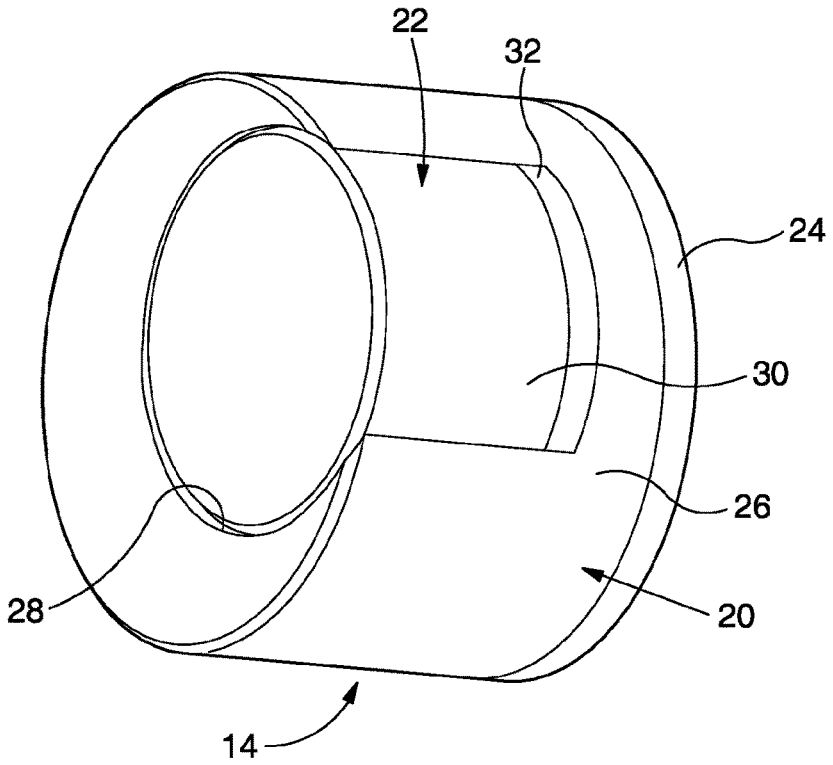
FIGS. 5*a* and 5*b* illustrate an alternative embodiment.
Figure 5B:
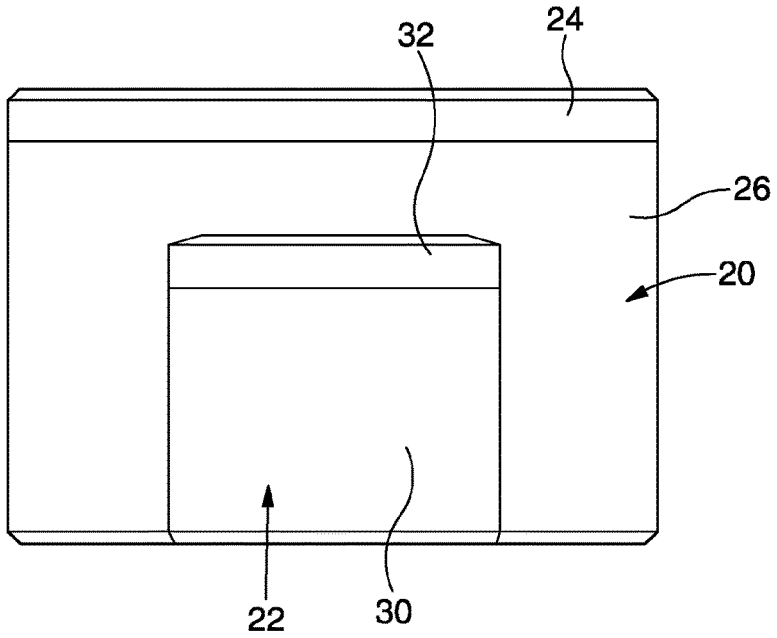

FIGS. 5*a* and 5*b* illustrate an alternative to the arrangement described hereinbefore. In the arrangement of FIGS. 5*a* and 5*b*, the secondary cutter 22 is again positioned eccentrically relative to the primary cutter 20, the positioning being such that in this arrangement a part of the secondary cutter 22 projects or protrudes from a side of the primary cutter 20 prior to wear of the cutting element 14. As a result, some of the benefits outlined hereinbefore will apply to the cutting element 14 from new, rather than applying only after a degree of wear has occurred. The arrangement of FIGS. 5*a* and 5*b* may incorporate any of the variants outlined hereinbefore.

The degree by which the secondary cutter 22 projects from the primary cutter 20 may be varied, and some examples are shown in FIG. 7, the level of protrusion being selected depending upon the application in which the cutting element 14 is to be used. By control over this and the rake angle and/or rate of penetration, it may be possible to control whether, initially, drilling is undertaken primarily by the primary cutter, the secondary cutter, or the cutters in combination.

Figure 6A:
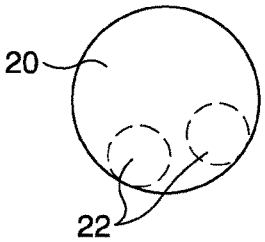
FIGS. 6*a*, 6*b* and 6*c* illustrate some further alternatives.
Figure 6C:
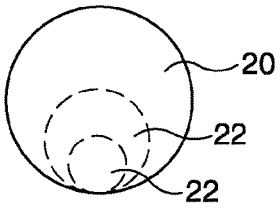
Figure 6B:
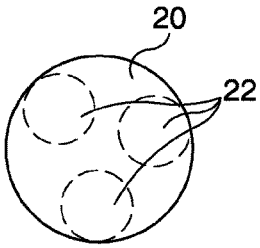

Whilst in the arrangements described hereinbefore only a single secondary cutter 22 is present in each cutting element 14, if desired two or more secondary cutters 22 may be present in each cutting element 14. These secondary cutters 22 may all be provided within respective recesses formed in the primary cutter, for example as shown in FIGS. 6*a* and 6*b*, or alternatively one or more of the secondary cutters may be located within a recess formed in another of the secondary cutters as shown in FIG. 6*c*.

Figure 8:
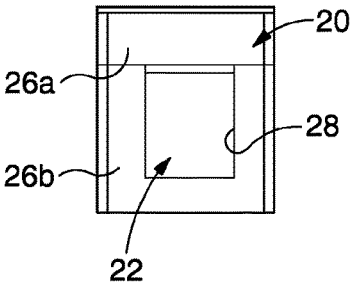
FIGS. 8 to 10 are diagrams illustrating alternative embodiments.

FIG. 8 illustrates an alternative embodiment. As mentioned hereinbefore, it may be desirable to arrange for the secondary cutter 22 to be free to rotate relative to the primary cutter 20. Where the recess 28 within which the secondary cutter 22 is located extends to a rear face of the primary cutter 20, ie the end face of the first substrate 26 remote from the first table 24, there is a risk that the process of securing the cutting element 14 in position on the drill bit body 10 could potentially result in the secondary cutter 22 being bonded to the bit body 10 and/or to the primary cutter 20, preventing this rotation from occurring. In the arrangement of FIG. 8, the first substrate 26 is of two part form, including a first part 26*a* to which the table 24 is bonded, and a second part 26*b* bonded to and extending rearward from the first part 26*a*. The second part 26*b* is formed with a blind bore or recess 28 within which the secondary cutter 22 is located, the blind bore or recess 28 being formed in a region of the second part 26*b* closest to the first part 26*a* with the result that the blind bore or recess 28 does not extend to the rear face of the first substrate 26. Consequently, the subsequent bonding of the cutting element 14 to the bit body 10 will not result in the secondary cutter 22 being bonded and fixed against rotation.

The two substrate parts 26*a*, 26*b* are conveniently bonded to one another using a known long substrate bonding technique.

As described hereinbefore, the use of the cutting elements 14 may result in enhanced durability. By way of example, it is thought that the useful working life of a cutting element 14 may be increased by in the region of 140% or more. This is achieved without significantly increasing the size or number of cutting elements 14, not significantly altering the amount of blade space required to accommodate the cutting elements 14.

Whilst the invention is described hereinbefore in connection with a rotary drill bit, it will be appreciated that it may be used in other applications such as in eccentric or concentric hole openers, reamers and the like.

Whilst specific embodiments of the invention are described hereinbefore, it will be appreciated that a wide range of modifications and alterations may be made thereto without departing from the scope of the invention.

The invention claimed is:

1. A cutting element comprising a primary cutter including a first table of a hard material bonded to a first substrate of less hard form, the first substrate of the primary cutter having a recess formed therein in which a secondary cutter is located, the secondary cutter comprising a second table of a hard material bonded to a second substrate of less hard material, the first and second tables being spaced apart from one another by at least part of the first substrate, wherein the recess is a blind bore extending from a surface of the first substrate remote from the first table such that the secondary cutter is completely enclosed within the first substrate before use.

2. A cutting element according to claim 1, wherein the primary and secondary cutters are arranged coaxially or eccentrically.

3. A cutting element according to claim 2, wherein the primary and secondary cutters are arranged eccentrically and the secondary cutter extends to the periphery of the primary cutter.

4. A cutting element according to claim 1, further comprising at least one additional secondary cutter.

5. A cutting element according to claim 4, wherein the additional secondary cutter is located within a respective recess formed in one of the first substrate and the substrate of the first mentioned secondary cutter.

6. A cutting element according to claim 1, wherein the first and second tables are of the same material as one another.

7. A cutting element according to claim 1, wherein at least one of the first and second tables is treated to remove a binder or catalyst material from at least part thereof.

8. A cutting element according to claim 1, wherein the material(s) of the first and second tables is selected from a list comprising tungsten carbide, silicon carbide, boron nitride, diamond, boron nitride carbide, polycrystalline diamond and polycrystalline cubic boron nitride.

9. A cutting element according to claim 1, wherein the first and second substrates are of the same material as one another.

10. A cutting element according to claim 1, wherein the material of at least one of the first and second substrates comprises a carbide material.

11. A cutting element according to claim 1, wherein the recess is formed by electronic discharge machining or by milling.

12. A cutting element according to claim 1, wherein the first substrate is of multipart form, the parts of which are bonded to one another, a part of the substrate including a through hole forming the recess.

13. A cutting element according to claim 1, wherein the secondary cutter is an interference fit in the recess, is brazed into the recess or is secured in the recess by retaining features.

14. A cutting element according to claim 1, wherein an axis of the secondary cutter is angled to an axis of the primary cutter.

15. A cutting element according to claim 1, wherein a periphery of at least one of the first and second tables is chamfered.

16. A cutting element according to claim 1, wherein the primary cutter and the secondary cutter are pre-sintered prior to assembly of the cutting element.

17. A cutting element according to claim 1, wherein the materials of the first and second tables differ from one another.

18. A cutting element according to claim 1, wherein the materials of the first and second substrates differ from one another.

19. A tool comprising a tool body upon which is mounted at least one cutting element as claimed in claim 1, wherein the tool comprises one of a drill bit and a hole enlargement tool.

20. A cutting element comprising a primary cutter including a first table of a hard material bonded to a first substrate of less hard form, the first substrate of the primary cutter having a recess formed therein in which a secondary cutter is located, the secondary cutter comprising a second table of a hard material bonded to a second substrate of less hard material, the first and second tables being spaced apart from one another by at least part of the first substrate, wherein the secondary cutter is free to rotate relative to the primary cutter.

21. A method of manufacture of a cutting element comprising the steps of:

sintering a primary cutter including a first table of a hard material bonded to a first substrate of less hard form, the first substrate of the primary cutter having a recess formed therein, the recess comprising a blind bore extending from a surface of the first substrate remote from the first table to a location spaced from the first table;

sintering a secondary cutter comprising a second table of a hard material bonded to a second substrate of less hard material; and locating the secondary cutter in the recess formed in the first substrate such that the first and second tables are spaced apart from one another by at least part of the first substrate and the secondary cutter is completely enclosed within the first substrate.

* * * * *